United States Patent [19]

Owens

[11] 4,450,847

[45] May 29, 1984

[54] WRAPPER FOR SMOKING ARTICLES AND METHOD

[75] Inventor: William F. Owens, Pisgah Forest, N.C.

[73] Assignee: Olin Corporation, Pisgah Forest, N.C.

[21] Appl. No.: 366,315

[22] Filed: Apr. 7, 1982

[51] Int. Cl.[3] ..... A24D 1/02

[52] U.S. Cl. ..... 131/365; 131/331; 131/334; 131/335

[58] Field of Search ..... 131/365, 334, 335, 31

[56] References Cited

U.S. PATENT DOCUMENTS

| | | | |
|---|---|---|---|
| 2,733,720 | 2/1956 | Schur et al. | 131/365 |
| 2,890,704 | 6/1959 | Lamm | 131/365 |
| 2,998,012 | 8/1961 | Lamm | 131/365 |
| 4,231,377 | 11/1980 | Cline et al. | 131/365 |

*Primary Examiner*—Vincent Millin

*Attorney, Agent, or Firm*—Kerkam, Stowell, Kondracki & Clarke

[57] ABSTRACT

A wrapper for smoking articles such as cigarettes, cigars and the like containing precipitated amorphous magnesium hydroxide gel. Other components of the filler for the wrapper can be either an unreactive grade of magnesium oxide or calcium carbonate. For the most effective reduction in sidestream tar and visible sidestream smoke the basis weight of the paper should be between 30 g/M$^2$ and 100 g/M$^2$. The filler should constitute 30% to 60% of the total sheet weight. The precipitated magnesium hydroxide gel should be present to the extent of approximately 5% to 50% by weight of the total filler and preferably between 10% and 25%.

16 Claims, No Drawings

WRAPPER FOR SMOKING ARTICLES AND METHOD

TECHNICAL FIELD

This invention relates generally to smoking articles such as cigarettes, cigars and the like and the wrapper for the tobacco column thereof, and more particularly to an improved wrapper for such smoking articles for use either by itself or as an inner wrapper in combination with a conventional outer wrapper which significantly reduces the amount of visible sidestream smoke that normally emanates from a smoking article during static burning and which has substantially improved ash appearance over heretofor developed smoking articles with reduced visable sidestream smoke.

BACKGROUND OF THE PRIOR ART

A problem associated with smoking articles such as cigarettes or cigars is the amount of sidestream smoke that is given off during static burning, for example when the smoking article is idling and not being drawn upon by the smoker or is simply resting in an ashtray while burning. Visible sidestream smoke that is given off by a smoking article such as a cigarette during static burning is irritating and objectionable to nonsmokers in the vicinity of the idling cigarette.

A problem with heretofor developed wrappers that reduced visable sidestream smoke has been that they give a flaky and/or off color ash due to poor ashing characteristics of the wrappers. Various mechanisms have been incorporated into smoking articles to reduce visible sidestream smoke and to improve the characteristics of wrappers, but none to date has been commercially successful in overcoming both of these problems.

Probably the most effective means of reducing visible sidestream smoke, to date is disclosed and claimed in U.S. Pat. No. 3,231,377, Cline et al owned by applicant's assignee, Olin Corporation.

In this patent there is disclosed a wrapper for smoking articles such as cigarettes, cigars and the like containing at least 15% by weight magnesium oxide or its hydrate and at least 0.5% by weight of specific chemical adjuvant such as the alkali metal acetates, carbonates, citrates, nitrates or tartrates. The combination of magnesium oxide or its hydrate with any of the chemical adjuvants significantly reduces visible sidestream smoke that emanates during static burning from smoking articles employing the wrapper. The wrapper may comprise conventional cigarette paper with magnesium oxide and the adjuvant incorporated therein as the filler in the paper furnish or either or both of the additives may be applied to the paper as a coating. Wrappers containing the additives can be used in place of conventional wrappers for smoking articles or used as an inner wrapper for the tobacco column in combination with a conventional outer wrapping of cigarette paper or cigar wrap. The wrappers disclosed in this patent, while extremely effective in reducing sidestream smoke, consistently give an undesirable flaky off color ash.

Schur (in U.S. Pat. No. 2,733,720) discloses the use of minor amounts of asbestos fiber in certain cigarette papers to give more solid ash. These fibers would undoubtedly function to improve the ash from papers but are completely unacceptable for use in cigarettes in the light of present knowledge of inhalation hazards of asbestos. Similarly, Lamm (in U.S. Pat. No. 2,890,704 and U.S. Pat. No. 2,998,012) discloses cigarette wrappers made of interwoven glass fibers. It has been shown that glass fibers added to magnesium oxide filled paper give an acceptably solid ash. However, these too are unacceptable to the cigarette manufacturers.

BRIEF SUMMARY OF THE INVENTION

It has now been discovered that using magnesium hydroxide, in the form of an amorphous gel, as a cigarette paper filler component improves ash appearance and sidestream smoke reduction. Magnesium hydroxide in the preferred form can be produced by controlling conditions under which precipitation of the hydroxide gel is accomplished by adding an alkali to a solution of a soluble magnesium salt.

The present invention consists in the use of a small fraction of precipitated magnesium hydroxide gel in the cigarette paper filler. The other component of the filler can be either an unreactive grade of magnesium oxide and calcium carbonate. For the most effective reduction in sidestream tar and visible sidestream smoke, the basis weight of the paper should be between 30 $g/M^2$. and 100 $g/M^2$. The filler should constitute 30% to 60% of the total sheet weight. The precipitated magnesium hydroxide gel should be present to the extent of approximately 5% to 50% by weight of the total filler and preferably between 10% and 25%.

In accordance with this invention, a wrapper is provided for smoking articles such as cigarettes, cigars and the like having incorporated therein at least 5% by weight of magnesium hydroxide gel preferable in combination with other specific fillers whereby the combination acts to significantly reduce visible sidestream smoke emanating from the smoking article during static burning, and improves ashing. For best results one or more burning chemicals such as the chemical adjuvants of U.S. Pat. No. 3,231,377 also should be present in the wrapper to achieve the greatest reductions in sidestream smoke and the best ash appearance. Wrappers according to this invention may be made by incorporating the magnesium hydroxide gel and the other fillers in the wrapper pulp furnish or the additives may be applied to the wrapper as a coating. In the case of cigarette papers, they may be made using an ordinary paper furnish such as pulped wood or flax fibers to which is added a sufficient quantity of the gel. The magnesium hydroxide gel may be used alone or in combination with other conventional fillers such as magnesium oxide and/or calcium carbonate. The furnish of fiber pulp and fillers are then used to make a paper sheet on conventional papermaking machines. The sidestream smoke inhibitor and ash appearance improving magnesium hydroxide gel compositions of the invention may be applied to the paper at the size press on the paper machine or as a separate treating operation after the paper is produced. Likewise, instead of using the magnesium hydroxide gel in the furnish as a filler, it may be applied to the finished paper as a coating using rotogravure or other conventional coating techniques after the paper is made. The particular fiber furnish from which the wrappers are made is not critical and any of the cellulosic fiber pulps used in papermaking can be employed. The fiber pulps customarily used to make paper wrappers for cigarettes or the tobacco materials used to make cigar wrap are preferred. Thus, in addition to wood and flax fibers, the furnish may be pulped tobacco stalks or stems to which is added the magnesium hydroxide gel and the magnesium oxide and/or calcium carbonate may be used in the furnish used in making reconstituted tobacco sheets for cigar wrap.

Smoking article wrappers containing magnesium hydroxide gel with or without the other fillers according to this invention may be used as an inner wrapper under a normal outer wrapper for the tobacco column of the cigarette or cigar. Conventional cigarette paper, and preferably very porous or perforated cigarette paper, or cigar wrap is then used as the outer wrapping for the smoking article. Such a combination can reduce the tobacco weight necessary to make a statisfactory product, increases the tobacco rod firmness, and does not alter the appearance of the cigarette or cigar. Wrappers containing the additives according to this invention also may be used as the single wrap for a smoking article. With cigarettes, it is especially desirable to use high basis weight papers if only a single wrap is employed. Both of the additives are essentially white and therefore do not alter the appearance of the cigarette paper, which is especially important.

Reductions of at least 20% sidestream particulate matter yields are obtained in smoking articles in which wrappers according to this invention are employed and reductions of 75% or more can be achieved, depending uon the combination of magnesium hydroxide gel, other fillers and chemicals employed in the wrapper.

MAGNESIUM HYDROXIDE GEL FORMATION

Fine particle size magnesium hydroxide gels can be produced by carefully controlling conditions under which precipitation of the hydroxide is accomplished by adding an alkali to a solution of a soluble magnesium salt. In the recovery of magnesium from sea water or brine from wells, lime or dolomitic lime is used in a continuous process in which preformed hydroxide is added to provide initial seeds for crystal growth. A portion of the reactor effluent is then continuously recycled to control particle size. In the normal commercial recovery process, crystal growth continues to a point where the product is easily dewatered. The dewatering process removes soluble impurities. The particle size of the purified product is too large for use in carrying out the present invention even when the particles are reduced in size by wet grinding. If, however, a solution of a magnesium salt is mixed with a solution of water soluble alkali without taking any of the steps required for particle growth, magnesium hydroxide comes out of solution as an amorphous gel. This physical form of magnesium hydroxide is quite different than dispersions of even the smallest discrete crystalline particles. It has been discovered that deposition of these gels in or on paper would provide more intimate contact with and/or more complete coverage of paper fibers. Thus it is possible to achieve the desired reduction of sidestream smoke at lower levels of magnesium hydroxide in the paper. In addition, a major benefit of using magnesium hydroxide in the gel form is that ash color and solidity of the ash are improved resulting in acceptable cigarette papers.

Throughout the specification and claims the terms "magnesium hydroxide gel" mean an apparently homogenous substance or dispersion consisting of an aggregate of small particles in very close association with a liquid, and the gel at the concentrations used in this invention is actually broken into flocs floating in the aqueous medium.

DETAILED DESCRIPTION OF THE INVENTION

The present invention consists in the use of a minor fraction of freshly precipitated magnesium hydroxide gel in the cigarette paper filler. The other component of the filler can be an unreactive grade of magnesium oxide or calcium carbonate. For the most effective reduction in sidestream tar and visible sidestream smoke, the basis weight of the paper should be between 30 $g/M^2$ and 100 $g/M^2$. The filler should constitute 30% to 60% of the total sheet weight. The precipitated magnesium hydroxide gel should be present to the extent of approximately 5% to 50% by weight of the total filler and preferably between 10% and 25%.

Various methods can be used to incorporate the precipitated magnesium hydroxide gel in the paper. The hydroxide can be precipitated in a separate operation, for example, by adding sodium hydroxide to a solution of magnesium acetate. The appropriate quantity of the resulting gel is then mixed with the other ingredients of the paper furnish. Alternatively, the precipitation can be carried out in the presence of the fiber, the other filler component or both. Another approach is to treat paper already containing the major filler component first with a solution of magnesium salt then with a solution of alkali such as sodium or potassium hydroxide. These treatments can conveniently be done by successive size press operations, with or without intermediate drying.

The burning chemical or chemical adjuvant will generally be added to the paper by treatment with the appropriate solution at the size press on the paper machine. Concentration of the adjuvant in the paper can be controlled by adjusting the concentration of the treating solution. In the case of potassium acetate, for example, concentrations in the paper of 2% to 8% by weight and preferably 3% to 6% by weight have been found to give the best results. In embodiments of the invention where the magnesium hydroxide gel is precipitated in and/or on preformed paper, the chemical adjuvant will be derived as a by-product of the reaction of magnesium salt with alkali. Thus, the reaction of magnesium acetate with potassium hydroxide yields potassium acetate as a coproduct with magnesium hydroxide.

The following examples illustrate various aspects of the invention.

In general, separate amounts of Kentucky Referee 1R3 tobacco wrapped in conventional cigarette paper would have sidestream particulate yields in the range of from 22 to 30 mg/cigarette and these yields are to be considered as "control yields" when considering Tables I, II and III described hereinafter.

EXAMPLE NO. 1

This example shows that magnesium hydroxide precipitated as a gel prior to or during the papermaking operation is more effective in reducing sidestream smoke yields than preformed dispersions of fine magnesium hydroxide particles.

All of the papers used in this example were 100 $g/M^2$ flax handsheets with 50% total filler. The major constitutent of the filler was MagChem 10, an unreactive grade of magnesium oxide manufactured by Martin Marietta. The other component was magnesium hydroxide. Table I gives the concentration of magnesium hydroxide in the filler as well as its source.

Each paper was treated with 3.0% sodium acetate solution before being used to reroll matched weights of Kentucky Referee 1R3 tobacco for the sidestream smoke tests recorded in Table I.

TABLE I

| $Mg(OH)_2$ Percent By Wgt. In Filler | Source | Greiner Porosity (Seconds/ 50 cc) | Sidestream Tar (mg/cigarette) | Average Burn Time (Minutes) |
|---|---|---|---|---|
| 25 | A* | 15.5 | 13.7 | 8.9 |
| 15 | B** | 23.0 | 10.4 | *** |
| 10 | B** | 17.0 | 10.8 | 14.9 |
| 10 | B** | 8.5 | 12.3 | 12.6 |
| 5 | B** | 7.5 | 13.6 | 11.3 |

*Dow MHT-60 micronized to an average particle size less than 1 micrometer.
**Precipitated by adding magnesium acetate to a mixture of MagChem 10, fiber, and sodium hydroxide.
***Not-recorded.

EXAMPLE NO. 2

This example shows that sidestream tar reductions similar to those obtained with MagChem 10 can be achieved with calcium carbonate as the major filler component. It also indicates that a substantial reduction in sidestream tar can be achieved whether or not the precipitation is carried out in the presence of the flax fibers.

As in Example No. 1, all handsheets had basis weights of 100 g/m$^2$ with 50% total filler. All were treated with 3.0% sodium acetate before being used to reroll test cigarettes. The calcium carbonate used in these handsheets was manufactured by Mississippi Lime Company and had an average particle size of approximately 2 micrometers. Table II gives the concentration of magnesium hydroxide in the filler as well as its source.

TABLE II

| $Mg(OH)_2$ Percent By Wgt. In Filler | Source | Greiner Porosity (Seconds/ 50 cc) | Sidestream Tar (mg/cigarette) | Average Burn Time (Minutes) |
|---|---|---|---|---|
| 25 | A* | 13.7 | 13.1 | 8.9 |
| 15 | B** | 23.0 | 10.1 | 12.8 |
| 15 | C*** | 19.2 | 10.9 | 13.0 |

*Dow MHT-60 micronized to an average particle size less than 1 micrometer.
**Precipitated from magnesium acetate solution in a blender with calcium carbonate present.
***Precipitated from magnesium acetate solution in presence of fiber and calcium carbonate with rapid stirring.

EXAMPLE NO. 3

This example shows that the gel form of magnesium hydroxide is effective in reducing sidestream tar yields when it is precipitated directly in or on performed paper.

Flax handsheets, 100 g/m$^2$ in basis weight and containing 50% unreacted magnesium oxide (MagChem 10) as filler, were cut in strips and treated on a size press with a 10% solution of magnesium acetate. The paper strips were then dried, treated with a 6.25% solution of potassium hydroxide in a second pass through the size press, and redried. These treatments resulted in a 20% weight increase. The weight of potassium acetate produced by the reaction of magnesium acetate with two equivalents of potassium hydroxide is 3.4 times the weight of magnesium hydroxide precipitated. Thus, even if the reaction went to completion in the case of the treated handsheets just described, only a fraction of the 20% increase in weight would be due to the presence of precipitated magnesium hydroxide gel. Cigarettes rerolled in this treated paper had a static burn rate of 85 milligrams per minute and gave a sidestream tar yield of 12.6 milligrams per cigarette.

EXAMPLE NO. 4

In this example, it is seen that precipitation of magnesium acetate in the presence of the paper fibers gives only slightly lower yields of total sidestream tar per cigarette than when the fiber is not present but, because of a more profound effect on burning rate, the rate of sidestream smoke production and hence visible sidestream smoke is greatly reduced.

The handsheets of this example were again 100 g/m$^2$ in basis weight with 50% total filler. The filler contained 87% MagChem 10 inactive magnesium oxide and 13% magnesium hydroxide gel. Precipitation on the fiber was carried out by adding a magnesium acetate solution to the fiber slurry and then adding the quantity of sodium hydroxide required to precipitate magnesium hydroxide gel.

This operation was carried out with moderate agitation which was continued for approximately 4 minutes. The mixture was allowed to stand for 30 minutes before being used to make handsheets. Precipitation with no fiber present was carried out in a blender to reduce the size of any agglomerates which might form before combining the magnesium hydroxide gel slurry with the flax fiber and MagChem 10.

Strips of both types of handsheets were treated with 6% potassium acetate solution before being used to roll cigarettes or smoking tests. The test results are tabulated in Table III.

TABLE III

| Mode of Precipitation | Greiner Porosity (Seconds/ 50 cc) | Sidestream Tar (mg/cigarette) | Burn Time (Minutes) | Sidestream Tar (mg/minute) |
|---|---|---|---|---|
| Fiber Present | 12.1 | 9.3 | 11.5 | 0.81 |
| No Fiber Present | 13.6 | 9.6 | 9.4 | 1.02 |

The effectiveness of the amorphous magnesium hydroxide gel in combination with unreactive grade magnesium oxide or calcium carbonate containing wrappers for smoking articles such as cigarettes and cigars according to this invention is quite apparent from the foregoing illustrative examples. Many variations will become apparent to those skilled in the art and the invention is not limited to the preferred embodiments shown. Various modifications and changes may be made without departing from the spirit and scope of the invention as defined in the following claims:

I claim:

1. A wrapper for smoking articles such as cigarettes, cigars and the like comprising a cellulosic sheet containing, as filler, a small fraction of freshly precipitated amorphous magnesium hydroxide gel coated on or applied to the fibers of the sheet wherein the small fraction of amorphous magnesium hydroxide gel comprises 5% to 50% by weight of the total filler.

2. The wrapper as defined in claim 1 wherein the filler further contains an unreactive grade of magnesium oxide or calcium carbonate or both.

3. The wrapper as defined in claim 2 wherein the precipitated amorphous magnesium hydroxide gel comprises 10% to 25% by weight of the total filler.

4. The wrapper as defined in claim 1 wherein the filler further contains an unreactive grade of magnesium oxide or calcium carbonate or both; the basis weight of the sheet is between 30 $g/M^2$ and 100 $g/M^2$, the filler constitutes 30% to 60% of the total sheet weight and the precipitated magnesium hydroxide is present to the extent of approximately 5% to 50% by weight of the total filler.

5. The wrapper of claim 1 in which the cellulosic sheet is cigarette paper.

6. The wrapper of claim 1 in which the cellulosic sheet is cigar wrap.

7. The wrapper of claim 1 further including 2% to 8% by weight of potassium acetate as a chemical adjuvant.

8. A smoking article comprising a tobacco charge and a wrapper for the tobacco charge, said wrapper comprising a cellulosic sheet containing, as a filler, a small fraction of freshly precipitated amorphous magnesium hydroxide gel coated on or applied to the fibers of the sheet, whereby upon burning the smoking article visible sidestream smoke is reduced, wherein the precipitated amorphous magnesium hydroxide gel comprises 5% to 50% by weight of the total filler.

9. The smoking article as defined in claim 8 wherein the filler further contains an unreactive grade of magnesium oxide or calcium carbonate or both.

10. The smoking article as defined in claim 9 wherein the precipitated amorphous magnesium hydroxide gel comprise 10% to 25% by weight of the total filler.

11. The smoking article as defined in claim 8 wherein the filler further contains an unreactive grade of magnesium oxide or calcium carbonate, or both, and the basis weight of the sheet is between 30 $g/M^2$ and 100 $g/M^2$.

12. The smoking article defined in claim 8 further including 2% to 8% by weight of potassium acetate in the wrapper as a chemical adjuvant.

13. A method for reducing the visible sidestream smoke emanated from a smoking article comprising wrapping the tobacco charge in the smoking article in a combustible cellulosic sheet containing, as a filler, a small fraction of freshly precipitated amorphous magnesium hydroxide gel coated or applied to the fibers of the sheet, wherein the precipitated amorphous magnesium hydroxide gel comprises 5% to 50% by weight of the total filler.

14. The method as defined in claim 13 wherein the filler further contains an unreactive grade of magnesium oxide or calcium carbonate or both.

15. The method as defined in claim 14 wherein the precipitated amorphous magnesium hydroxide gel comprises 10% to 25% by weight of the total filler.

16. The method as defined in claim 14 further including adding to or forming on the fibers of the sheet 2% to 8% by weight of potassium acetate.

* * * * *